US006678961B1

(12) United States Patent
Panahi

(10) Patent No.: US 6,678,961 B1
(45) Date of Patent: Jan. 20, 2004

(54) COMBINED CHALK LINE AND ARTICULATED LEVEL DEVICE

(76) Inventor: Abbas Panahi, 5462 Tyhurst Walkway, #4, San Jose, CA (US) 95123

( * ) Notice: Subject to any disclaimer, the term of this patent is extended or adjusted under 35 U.S.C. 154(b) by 0 days.

(21) Appl. No.: 10/229,893

(22) Filed: Aug. 29, 2002

(51) Int. Cl.[7] ..... B44D 3/38

(52) U.S. Cl. ..... 33/414; 33/451; 33/1 LE; 33/334

(58) Field of Search ..... 33/413, 414, 451, 33/755, 756, 757, 760, 761, 1 LE, 353, 354, 365, 369, 377, 379, 391, 392, 393, 333, 334

(56) References Cited

U.S. PATENT DOCUMENTS

| | | | | | |
|---|---|---|---|---|---|
| 987,863 | A | * | 3/1911 | Cram | 33/1 R |
| 3,105,303 | A | * | 10/1963 | Frizzell | 33/761 |
| 3,568,322 | A | * | 3/1971 | Showers | 33/413 |
| 3,664,032 | A | * | 5/1972 | Tompkins | 33/334 |
| 3,890,717 | A | * | 6/1975 | Haun | 33/413 |
| 4,189,844 | A | | 2/1980 | Riggins, Sr. | |
| 4,228,588 | A | | 10/1980 | Horton, Jr. | |
| 4,318,226 | A | * | 3/1982 | Engelhart | 33/334 |
| 4,364,175 | A | * | 12/1982 | Levake et al. | 33/353 |
| 4,438,538 | A | | 3/1984 | Larson | |
| 4,551,922 | A | * | 11/1985 | Someya | 33/414 |
| 4,697,349 | A | * | 10/1987 | Lee | 33/414 |
| 5,103,569 | A | * | 4/1992 | Leatherwood | 33/379 |
| 5,119,565 | A | * | 6/1992 | Horvath et al. | 33/414 |
| 5,239,761 | A | * | 8/1993 | Wu et al. | 33/451 |
| 5,430,952 | A | * | 7/1995 | Betts | 33/760 |
| 5,444,919 | A | * | 8/1995 | Alves | 33/414 |
| 6,148,529 | A | | 11/2000 | Kennedy | |
| 6,345,448 | B1 | * | 2/2002 | Chontos | 33/334 |

FOREIGN PATENT DOCUMENTS

DE 19846963 A1 * 4/2000

* cited by examiner

*Primary Examiner*—Diego Gutierrez
*Assistant Examiner*—Madeline Gonzalez
(74) *Attorney, Agent, or Firm*—Sturm & Fix LLP

(57) ABSTRACT

A combined chalk line and articulated level device (10) including a base member (20) having an enlarged vertical mounting face (22) that is fixedly connected to a conventional chalk line dispensing member (30) having a quantity of chalk line (31) that is releasably engagable with an articulated level unit (13) including a bubble level member (40) affixed to a mounting plate element (41) that is pivotally connected to the base member (20) and operatively associated with a roller bobbin (48) to maintain a portion of the quantity of chalk line (31) parallel to the longitudinal axis of the bubble level member (40).

7 Claims, 3 Drawing Sheets

COMBINED CHALK LINE AND ARTICULATED LEVEL DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of carpentry or masonry tools in general and in particular to a combined chalk line and articulated level device that is adapted to mark straight lines on a vertical surface over an extended distance.

2. Description of Related Art

As can be seen by reference to the following U.S. Pat. Nos. 4,189,844; 4,438,538; 6,148,529; and, 4,228,588, the prior art is replete with myriad and diverse leveling, measuring, and protracting arrangements.

While all of the aforementioned prior art constructions are more than adequate for the basic purpose and function for which they have been specifically designed, they are uniformly deficient with respect to their failure to provide a simple, efficient, and practical combined chalk line and leveling arrangement that is adapted to mark elongated straight lines on vertical wall surfaces great distances spanning uneven terrain and inclined grades.

As most plumbers, electricians and general contractors are all too well aware, there are many instances wherein a long straight horizontal line must be impressed upon a vertical surface or used to verify the straightness of a run of building components.

As a consequence of the foregoing situation, there has existed a longstanding need in the building trades for a new and improved combined chalk string and articulated level device that is capable of registering a straight line relative to a vertical surface; and the provision of such a construction is a stated objective of the present invention.

BRIEF SUMMARY OF THE INVENTION

Briefly stated, the combined device that forms the basis of the present invention comprises in general a base unit, a chalk line dispensing unit and an articulated level unit wherein the chalk line dispensing unit and the articulated level unit are operatively connected to one another and carried by the base unit.

As will be explained in greater detail further on in the specification, the heart of this invention revolves around the articulated level unit which is pivotally disposed relative to the base unit and includes means for maintaining a portion of the chalk line contained within the chalk line dispensing unit in a parallel relationship relative to the longitudinal axis of a bubble level member such that the user can determine when the payed out portion of chalk line is disposed in a horizontal plane relative to a vertical surface; such that the chalk line can mark the vertical surface or serve as a visual reference relative to the alignment of a horizontal run on said vertical surface.

While many prior art constructions are suitable for checking or marking a horizontal line over a relatively short distance, the present invention is suitable for use over extended distances.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
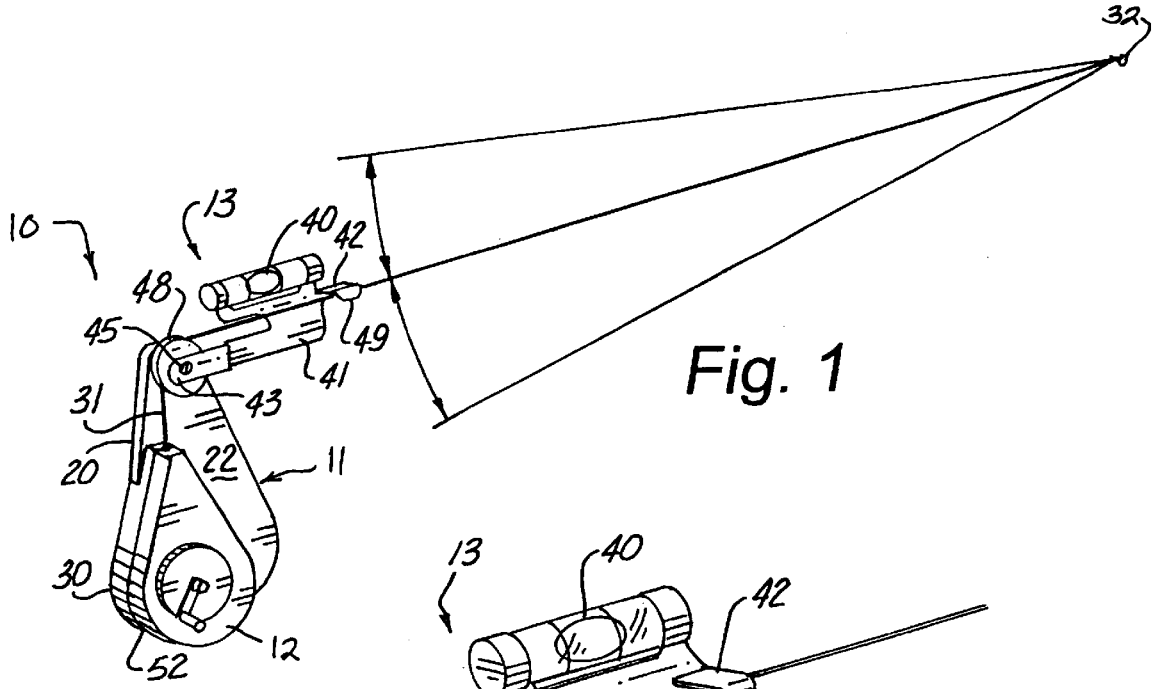
FIG. 1 is a perspective view of the combined device in use.

As can be seen by reference to the drawings, and in particularly to FIG. 1, the combined chalk line and articulated level device that forms the basis of the present invention is designated generally by the reference number 10. The combined device 10 comprises in general a base unit 11, a chalk line dispensing unit 12, and an articulated level unit 13. These units will now be described in seriatim fashion.

Figure 2:
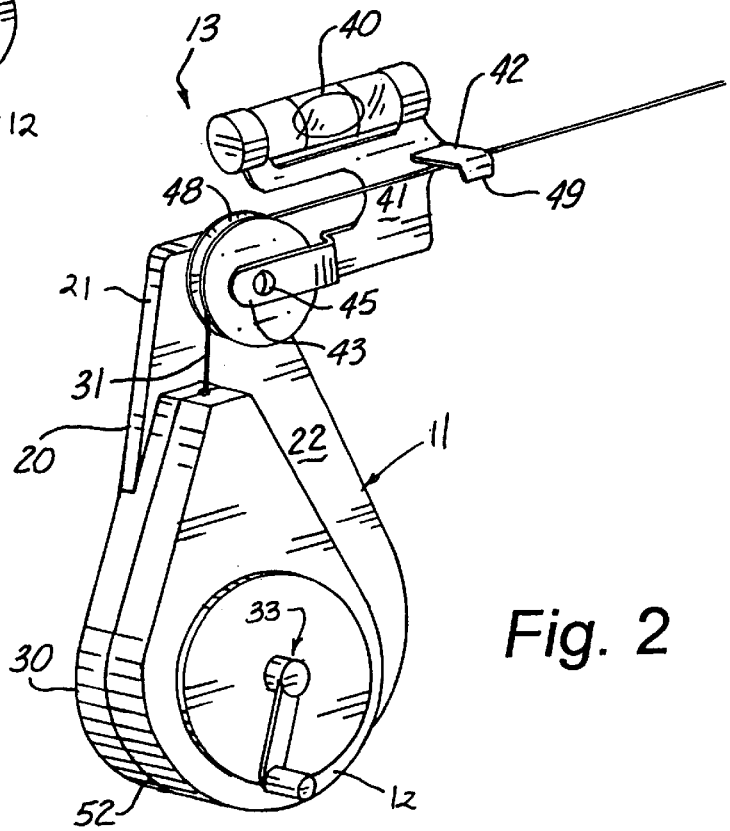
FIG. 2 is a perspective view of the combined device with the chalk line disposed in the horizontal plane.

As shown in FIGS. 1 and 2, the base unit 11 comprises a generally rigid thin flat base member 20 preferably fabricated from plastic 21 or the like and having an enlarged generally tear shaped vertical mounting face 22.

As can also be seen by reference to FIGS. 1 and 2, the chalk line dispensing member 30 containing a quantity of chalk line 31 the free end of which is provided with a metal ring 32 that is adapted to be releasably secured to a vertical surface by any number of well recognized fastening arrangements such as nailing, tying, etc.

In addition, the conventional chalk line dispensing member 30 is fixedly secured to the mounting face 22 of the base member 20 in a vertically upright position such that the chalk line 31 is dispensed from the chalk line dispensing member 30 proximate to, but spaced from, the narrow end of the tear shaped mounting face 22 of the base member 20.

As can also be seen by reference to FIG. 2, the conventional chalk line dispensing member 30 is also provided with a rotatable crank handle 33 that is used to retract the chalk line 31 into the dispensing member 30 in a well recognized fashion after use.

Figure 3:
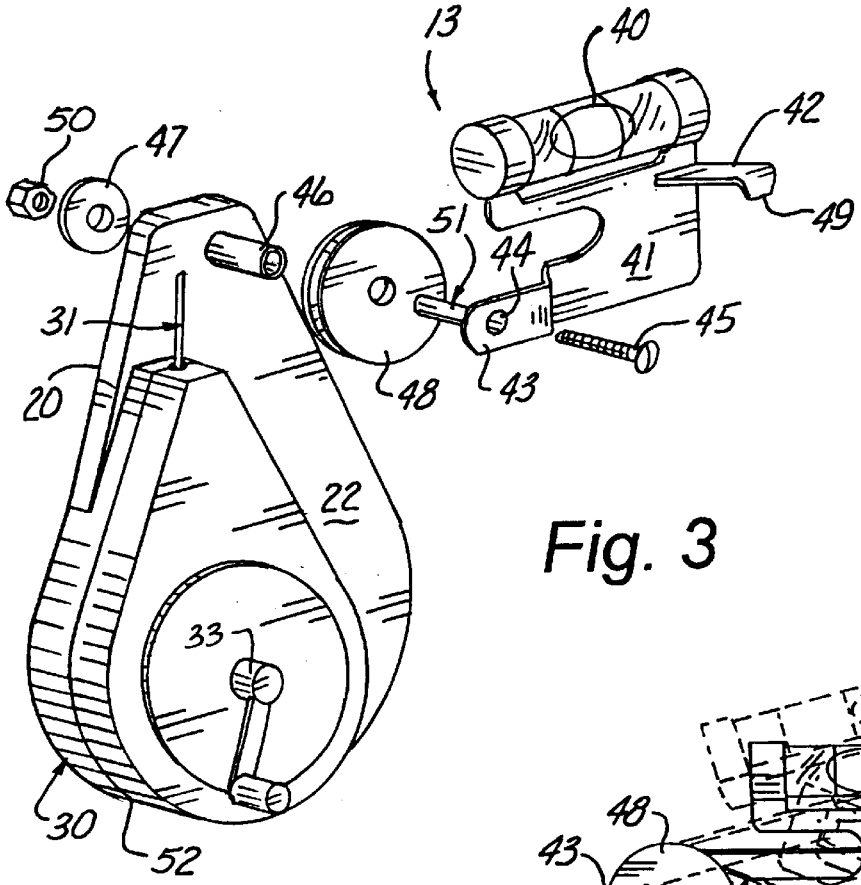
FIG. 3 is an exploded perspective view of the articulated level unit relative to the base unit.
Figure 5:
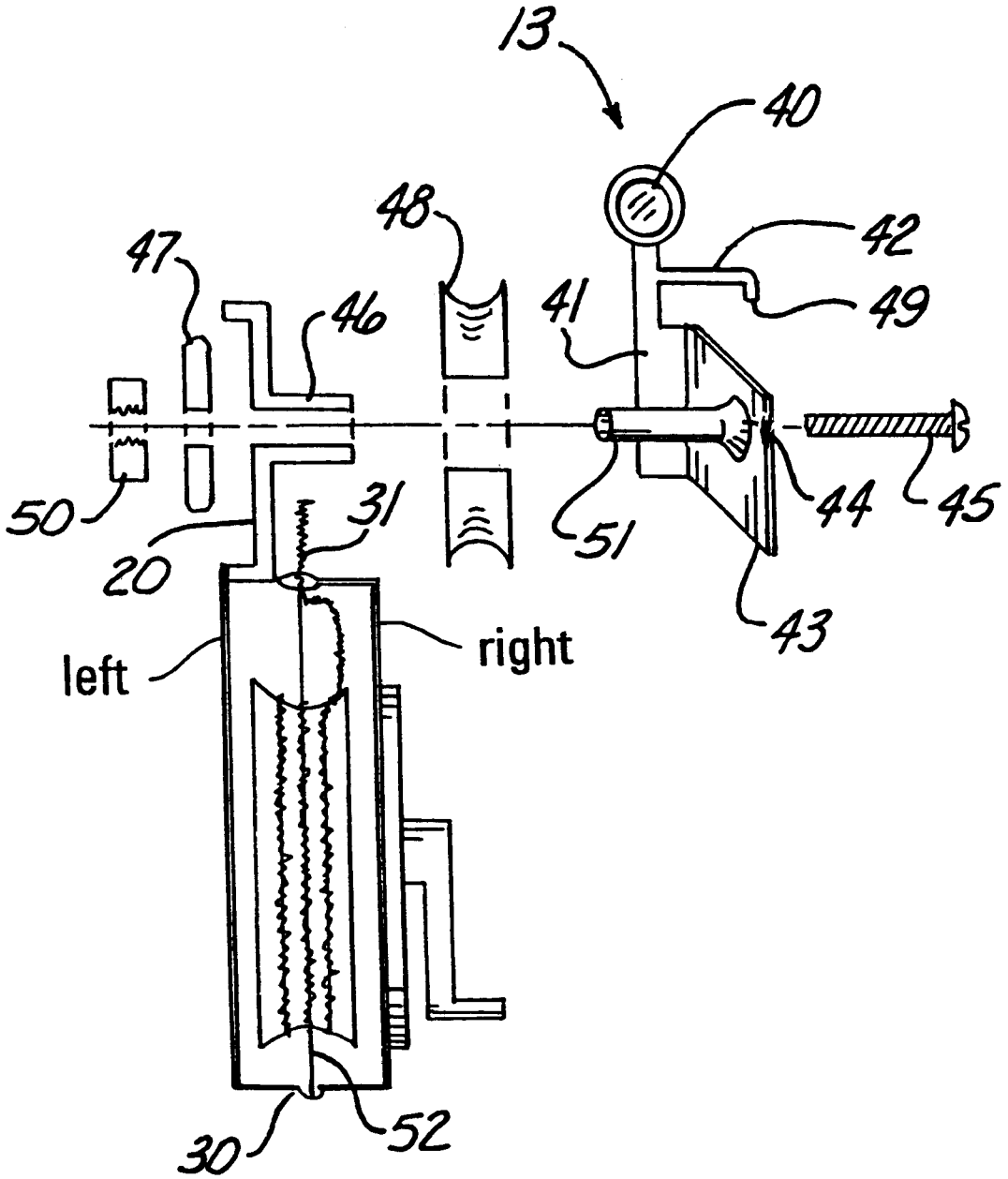

Turning now to FIGS. 3 and 5, it can be seen that the articulated level unit 13 comprises a bubble level member 40 disposed on top of a contoured support plate element 41 having an outwardly horizontal projecting element finger 42 disposed proximate its forward end and an offset flange 43 provided with a central aperture 44 that extends into a rearwardly extending tubular exterior 51 wherein, the central aperture 44 is dimensioned to receive the stem of a conventional fastener 45 that passes through a hollow axle element 46 that projects outwardly from the mounting face 22 of the base member 20 proximate its tapered upper end.

Still referring to FIG. 3, it can be seen that the articulated level unit 13 also includes a washer element 47 and a nut 50 that are engaged by the fastener 45 and a roller bobbin 48 that are rotatably disposed on the axle element 46 and disposed intermediate the mounting face 22 of the base member 20 and the offset flange 43 of the level support plate 41.

In addition, the outer end of the outwardly projecting finger element 42 is provided with a downwardly depending lip 49 and the conventional fastener 45 is provided with a locking nut 50 that captively engages the washer element 47, the roller bobbin 48, and the offset flange 43 on the hollow axle element 46 in a rotatable fashion for reasons that will be explained presently.

Figure 4:
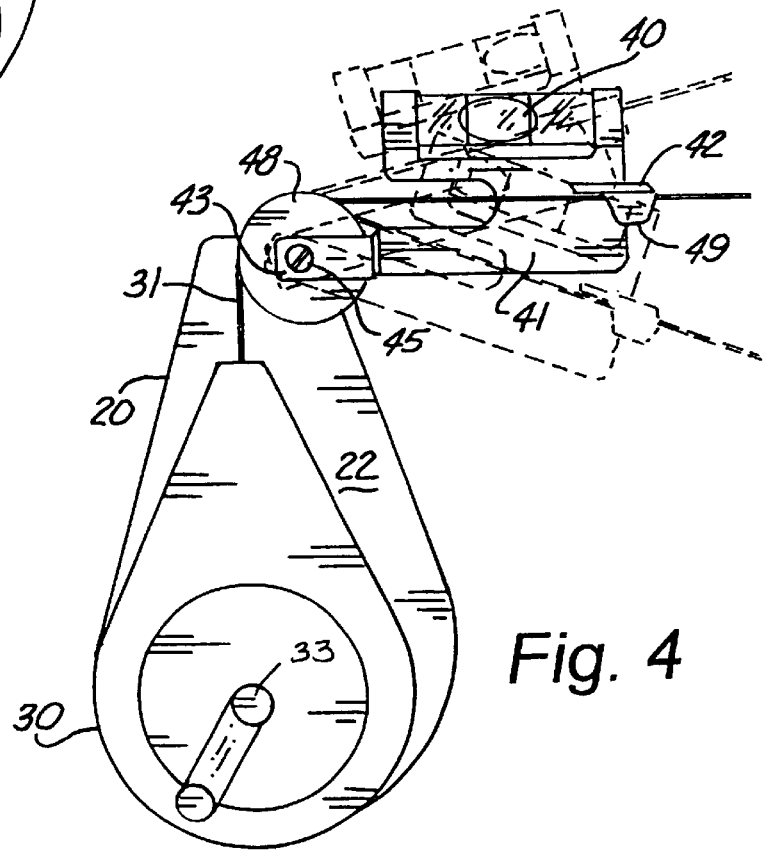
FIG. 4 is a side elevation view illustrating the articulated movement of the level unit relative to the base unit; and, FIG. 5 is a cross-sectional exploded perspective view of the combined device.

As can best be appreciated by reference to FIGS. 2 and 4, the bubble unit 13 is disposed on the base unit 11 such that the chalk line 31 will pass over the roller bobbin 48 and under the finger element 42 in a parallel orientation relative to the longitudinal axis of the bubble level member 40 wherein the downwardly depending lip 49 of the finger element will prevent the lateral displacement of the chalk line 31 relative to the bubble level member 40.

This arrangement assures that when the chalk line 31 has been payed out of the chalk dispensing member 30 the desired distance, the mounting plate member 41 can be rotated relative to the axle element 46 on the base member 20 to center the bubble of the level member 40 to dispose the chalk line 31 in a horizontal disposition relative to a selected vertical surface such as a well or the like.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A combined chalk line and articulated level device comprising:

a base unit including a base member having an enlarged vertical mounting face, a chalk line dispensing member fixedly secured to said enlarged vertical mounting face and provided with a quantity of chalk line having a free end adapted to be releasably connected to a vertical surface; and, an articulated level unit including a bubble level member pivotally disposed on the vertical mounting face and provided with means for maintaining a portion of the chalk line in a parallel orientation with the longitudinal axis of the bubble level member: wherein, the bubble level member is further provided with a support plate element that is pivotally associated with the vertical mounting face of the base member; and, the support plate element has a forward end provided with an outwardly projecting horizontal finger element adapted to engage a portion of the chalk line; and wherein, the vertical mounting faces of the base, member is provided with an outwardly projecting hollow axle element and the support plate element is provided with a rearwardly extending hollow tubular extension element that is dimensioned to be received in the hollow axle element.

2. The combined device as in claim 1; further comprising:

a roller bobbin rotatable disposed on the base member and adapted to releasably receive a portion of the chalk line.

3. The combined device as in claim 1; wherein, the horizontal finger element has an outer end provided with a downwardly depending lip.

4. The combined device as in claim 3; wherein, the support plate element has a rear end provided with an offset flange.

5. The combined device as in claim 4; wherein, said offset flange is disposed adjacent said roller bobbin.

6. The combined device as in claim 1; wherein, the support plate element has an outer face provided with an aperture in open communication with the rearwardly extending hollow tubular extension element.

7. The combined device as in claim 6; wherein, the aperture and the hollow tubular extension element are dimensioned to receive a conventional elongated fastener.

* * * * *